US011940252B2

(12) United States Patent
Marin Riquelme

(10) Patent No.: US 11,940,252 B2
(45) Date of Patent: Mar. 26, 2024

(54) PROJECTILE FOR FIREARMS

(71) Applicant: QUANTUM AMMUNITION, LLC, Auburn Hills, MI (US)

(72) Inventor: Juan Carlos Marin Riquelme, Ripoll (ES)

(73) Assignee: QUANTUM AMMUNITION, LLC, Auburn Hills, MI (US)

( * ) Notice: Subject to any disclaimer, the term of this patent is extended or adjusted under 35 U.S.C. 154(b) by 769 days.

(21) Appl. No.: 16/940,274

(22) Filed: Jul. 27, 2020

(65) Prior Publication Data

US 2021/0116220 A1 Apr. 22, 2021

(30) Foreign Application Priority Data

Oct. 16, 2019 (ES) ..... 201930918

(51) Int. Cl.
*F42B 10/48* (2006.01)

(52) U.S. Cl.
CPC ..... *F42B 10/48* (2013.01)

(58) Field of Classification Search
CPC ..... F42B 10/24; F42B 30/02; F42B 10/48; F42B 12/06; F42B 12/08; F42B 10/08; F42B 12/04; F42B 10/22; F42B 12/34; F42B 12/02
USPC ..... 102/501, 510, 514, 507, 519, 517
See application file for complete search history.

(56) References Cited

U.S. PATENT DOCUMENTS 13,469 A * 8/1855 Mcburth ..... F42B 12/204 271/178
33,863 A * 12/1861 Woodbury ..... F42B 10/22 244/3.23
1,169,704 A * 1/1916 Wesner ..... F42B 12/06 102/519
1,596,180 A * 8/1926 Albert ..... F42B 10/24 102/499
2,612,108 A 9/1952 Schmidt
4,655,140 A 4/1987 Schirneker
4,867,065 A * 9/1989 Kaltmann ..... F42B 8/04 102/444
5,116,224 A * 5/1992 Kelsey, Jr. ..... F42B 10/22 102/501
5,133,261 A * 7/1992 Kelsey, Jr. ..... F42B 10/22 102/501
D632,357 S 4/2011 Dixon
(Continued)

*Primary Examiner* — Jonathan C Weber
(74) *Attorney, Agent, or Firm* — Eric B. Fugett; Mark A. Pitchford; Pitchford Fugett, PLLC

(57) ABSTRACT

A projectile for firearms comprises a body defining a generally cylindrical base portion opposite an ogive. The body further defines a longitudinal axis. A plurality of pairs of adjacent flutes are defined in the ogive. Each flute has a radius of curvature which decreases along the longitudinal axis from a leading edge to a trailing edge of the flute. The adjacent flutes of each pair define and are substantially symmetrical about a central ridge. Each ridge is coplanar with the longitudinal axis and has a lesser depth than a bottom surface of each flute relative to a curved outer surface of the ogive. Each ridge has a radius of curvature which decreases along the longitudinal axis from an origin to a terminus of the ridge. The decreasing radius of curvature of the flutes prevents the projectile from over penetrating human-sized soft tissue targets without sacrificing energy transfer to such targets.

17 Claims, 5 Drawing Sheets

(56) References Cited

U.S. PATENT DOCUMENTS

| | | | | |
|---|---|---|---|---|
| 9,581,402 | B2 * | 2/2017 | Minnicino, II | F41A 21/16 |
| 9,709,368 | B2 * | 7/2017 | Mahnke | F42B 5/025 |
| 9,829,293 | B2 | 11/2017 | Defense | |
| 9,841,260 | B2 | 12/2017 | Lemke | |
| 10,036,619 | B2 * | 7/2018 | Fricke | F42B 12/04 |
| 10,126,105 | B2 | 11/2018 | Lemke et al. | |
| 10,345,085 | B2 * | 7/2019 | Fricke | F42B 30/02 |
| 10,823,540 | B2 * | 11/2020 | Marin | F42B 10/24 |
| 10,866,075 | B2 * | 12/2020 | Fricke | F42B 30/02 |
| 11,041,703 | B2 * | 6/2021 | Mahnke | F42B 12/06 |
| 11,156,442 | B1 * | 10/2021 | Kampo | F42B 10/48 |
| 2006/0096491 | A1 * | 5/2006 | Fichot | F42B 10/22 102/501 |
| 2013/0263754 | A1 * | 10/2013 | Neme | F42B 10/24 102/517 |
| 2015/0308799 | A1 | 10/2015 | Powers | |
| 2015/0354929 | A1 * | 12/2015 | Minnicino, II | F41A 21/16 102/520 |
| 2016/0231093 | A1 * | 8/2016 | Lemke | F42B 10/24 |
| 2017/0199019 | A1 * | 7/2017 | Fricke | F42B 12/04 |
| 2018/0209770 | A1 * | 7/2018 | Fricke | F42B 5/02 |
| 2019/0113318 | A1 * | 4/2019 | Taylor | F42B 10/08 |
| 2019/0113320 | A1 | 4/2019 | Folaron | |
| 2019/0186879 | A1 | 6/2019 | Marin | |

* cited by examiner

PROJECTILE FOR FIREARMS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims priority benefit of Spanish Patent Application No. 201930918, filed Oct. 16, 2019, which published as ES 2753190 on Apr. 7, 2020, the entirety of which is hereby incorporated by reference.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to ammunition for firearms, and more particularly, to projectiles for use in ammunition cartridges for firearms.

The use of composite materials for the manufacture of bullets or projectiles for firearms is known. Composite materials traditionally used in the formation of projectiles for ammunition cartridges include polymeric composite materials. Polymeric composite materials suitable for use in the manufacture of projectiles for ammunition cartridges are known in the art. Exemplar materials described, for example, in U.S. Pat. No. 10,126,105, which is incorporated by reference herein. In general, polymeric composites suitable for use in the manufacture of projectiles for ammunition cartridges include at least one polymeric material infused of blended with at least one metallic material, such as, but not limited to, copper.

Polymeric composite materials are markedly lighter than conventional metallic materials traditionally used to form projectiles for firearms ammunition. Consequently, projectiles formed from polymeric composite materials typically travel at a higher velocity and can spin much more quickly than conventional metallic projectiles of the same caliber when propelled with an equivalent propellant charge. Although this increase in velocity and spin can provide certain benefits, such as increased hydraulic displacement and larger temporary and permanent wound channels and cavities upon impact of the projectile with soft targets (e.g., animal tissue, human tissue, ballistic gels), it can also result in certain potentially undesirable variations in terminal effects and overall performance.

For example, some high velocity polymeric composite projectiles can fragment upon impact with ballistic gels and animalian tissues. This dramatically limits the ability of such projectiles to transfer energy to a target, and thus negatively effects their stopping power. Other high velocity projectiles (both polymeric composite and traditional metallic) can over penetrate (i.e., pass completely through) soft targets, which is particularly undesirable for projectiles intended for use in home and self-defense scenarios. By contrast, it is desirable for projectiles, particularly those intended for use in defensive applications, to transfer maximum kinetic energy to the target upon impact and create large, immediately incapacitating wound channels without passing completely through the soft tissues of such targets as animals and persons.

Accordingly, what is needed are improvements in projectiles for firearms and ammunition cartridges.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The presently disclosed subject matter overcomes or minimizes some or all of the identified deficiencies of the prior art, as will become evident to those of ordinary skill in the art after a study of the information presented in this document.

The present invention provides a projectile for firearms which can be used in the manufacture of ammunition cartridges for handguns and rifles. The projectile disclosed herein is formed with a unique configuration of paired, adjacent flutes which extend longitudinally along an impact portion or ogive of the projectile. The pairs of adjacent flutes define and are substantially symmetrical about a central concave ridge, which can function as a cutting surface as the projectile passes through (i.e., penetrates) soft tissues. The flutes of each pair are concave and can have a longitudinal radius of curvature which decreases between a leading edge and a trailing edge of each flute. This configuration causes the flutes to direct soft tissues and fluids encountered by the projectile radially outward from the projectile and thereby provides the projectile with a braking effect as it penetrates a soft tissue target. This prevents the projectile from over penetrating the target and simultaneously increases or optimizes the transfer of kinetic energy from the projectile to the target. The ridge can also have a radius of curvature which decreases toward a rear end or terminus of the ridge in order to further increase the braking effect and resultant energy transfer. Consequently, projectiles constructed in accordance with the present invention are particular effective for use in the manufacture of ammunition cartridges intended for home and self-defense.

Accordingly, in one aspect, the invention provides a projectile comprising a body defining a longitudinal axis and an ogive. The ogive defines a plurality of pairs of adjacent flutes which themselves define and are substantially symmetrical about a central ridge. The flutes extend along the longitudinal axis and have a radius of curvature which decreases between a leading edge and a trailing edge of the flute.

In another aspect, the invention provides a projectile comprising a body including a longitudinal axis, a cylindrical base portion, and a tapered impact portion in which is formed a plurality of pairs of adjacent, substantially symmetrical flutes which define and are separated by a plurality of substantially symmetrical ridges. Each ridge is formed by adjacent surfaces of each pair of adjacent flutes that intersect along a concave intersection curve.

In yet another aspect, the invention provides a projectile comprising a body defining a longitudinal axis, a cylindrical base portion, and a tapered impact portion having a curved outer surface. Three indentations are defined in the impact portion. The indentations are equidistantly spaced around a circumference of the impact portion and located at the same relative position along the longitudinal axis. Each indentation is formed by two substantially symmetrical curved surfaces which intersect along a ridge that is coplanar with the longitudinal axis and has a lesser depth relative to the curved outer surface of the impact portion than a bottom of the two curved surfaces.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

Figure 1:
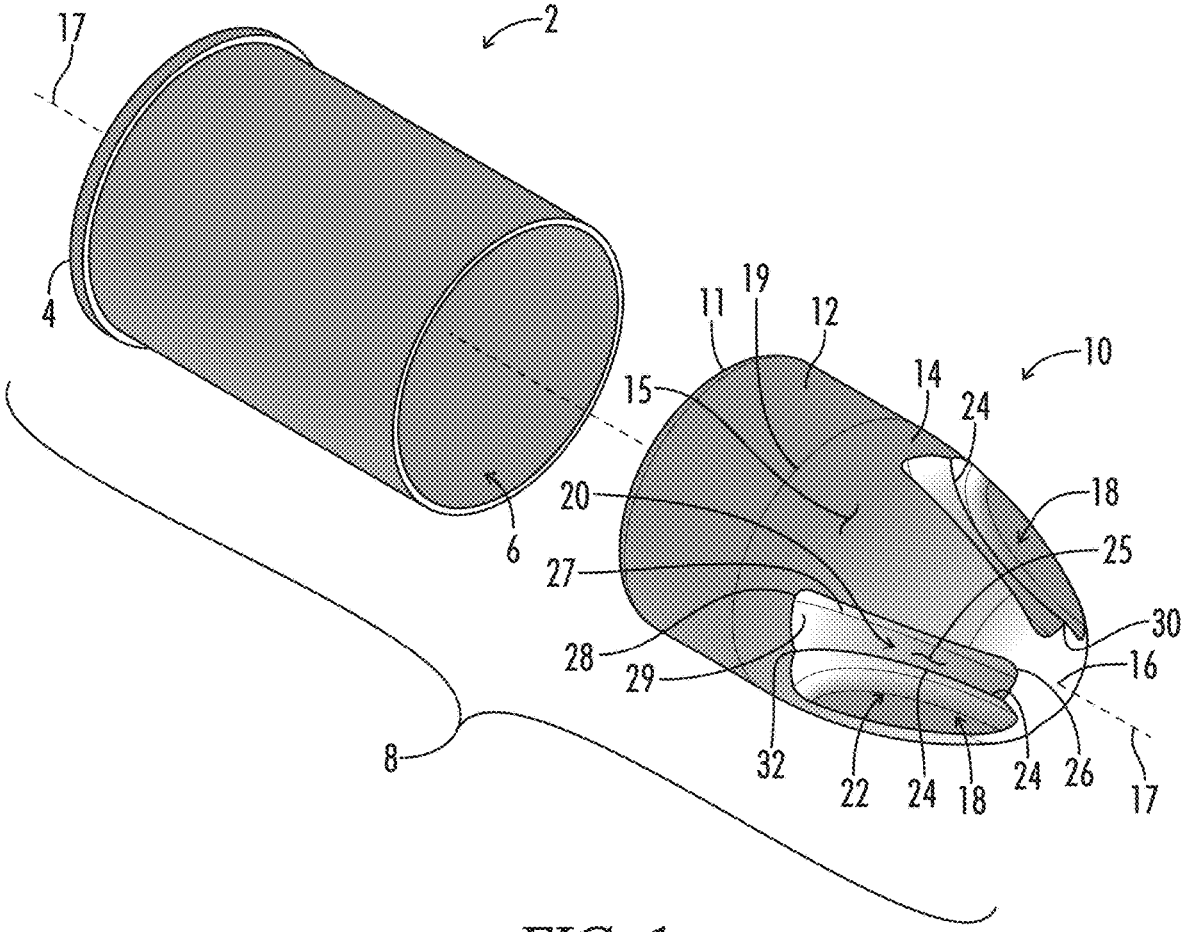
FIG. 1 is an exploded isometric view of a cartridge utilizing a projectile for firearms constructed in accordance with an embodiment of the present invention.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the portions relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The term "substantially" as used herein means within the limits of industry accepted manufacturing tolerances.

This description and appended claims include the words "below", "above", "side", "top", "bottom", "upper", "lower", "when", "vertical", "horizontal", etc. to provide an orientation of embodiments of the invention to allow for proper description of example embodiments. The foregoing positional terms refer to the projectile when in an upright orientation as described herein, unless otherwise specified. An "upright" position of a projectile for a firearm is considered to be the position when the projectile is in a generally vertical orientation as depicted in, for example, FIG. 4. "Forward" is generally the direction in which a projectile is propelled from a firearm in which an ammunition magazine to which the magazine extension is coupled is received in the firearm, and "rearward" is generally toward a user shooting the firearm.

Further, the terms "above", "below", "over", and "under" mean "having an elevation or vertical height greater or lesser than" and are not intended to imply that one object or component is directly over or under another object or component, unless otherwise specified. The term "when" is used to specify orientation for relative positions of components, not as a temporal limitation of the claims or apparatus described and claimed herein unless otherwise specified.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Referring now to FIGS. 1-10, there is shown a projectile 10 for a firearm constructed in accordance with an embodiment of the present invention. The projectile 10 is a monolithic body 10 including a generally cylindrical posterior or base portion 12 and a tapered impact portion or ogive 14. The ogive 14 intersects the base portion 12 at a margin 19. The base portion 12 has a generally planar rearmost surface 13. The ogive has a curved outer surface 15 and a tip 16 located at the forwardmost end of the ogive 14. The body 10 defines a longitudinal axis 17 extending from the rear surface 13 of the base 12 to the tip 16 of the ogive 14. In the embodiment shown, the tip 16 is a rounded nose. However, in other embodiments, the tip 16 can be a sharp point, or a meplat (not shown). A meplat is a generally flat leading surface of a projectile which defines a plane substantially orthogonal to the longitudinal axis.

The projectile 10 has a projectile diameter $D_P$ and a projectile length $L_P$. The projectile length $L_P$ extends from the tip 16 of the ogive 14 to the rearmost surface 13 of the base portion 12. The ogive 14 has an ogive length $L_O$ that extends from the tip 16 to the margin 19. The base portion 12 has a base length $L_B$ that extends from the margin 19 to the rearmost surface 13. A rear edge 11 of the base portion 12 can be rounded or beveled to facilitate insertion of the projectile 10 into a shell casing 2 during assembly and manufacture of an ammunition cartridge 8 for a firearm, such as a handgun (not shown).

As shown in FIG. 1, a shell casing 2 typically includes a generally tubular body 2 having an enclosed rear end 4 with an outwardly extending rim opposite an open forward end 6 in which the base portion 12 of the projectile 10 can be received and seated during manufacture and assembly of the cartridge 8. A primer (not shown) is typically positioned in an aperture formed in the first end 4 of the casing 2, while the interior of the casing is filled with a propellant (e.g., smokeless powder) which is ignited by the primer upon discharge of the firearm. Ignition of the propellant expels the projectile from the casing 2 and out the barrel of the firearm toward a target. As such, the impact portion or ogive 14 of the projectile 10 is the first portion of the projectile to impact the target upon discharge. The design of the surface(s) of the ogive 14, combined with the velocity of the projectile 10 during flight, largely determine the effect of the projectile 10 when it impacts and transfers its energy to the target.

In order to minimize or prevent over penetration of soft targets, projectiles 10 constructed in accordance with the present invention further include a plurality of indentations 18 formed in the ogive 14. The projectile 10 depicted in the figures includes three indentations 18. However, projectiles having as few as two and as many as four indentations 18 are contemplated herein and encompassed by the claims. The indentations 18 are defined by a number of real and imaginary reference surfaces, as explained in more detail below. The indentations 18 are uniquely configured to provide a braking effect as the projectile 10 penetrates a soft tissue target in order to prevent overpenetration of the target by the projectile. The configuration of the various curved surfaces forming the indentations 18 disclosed herein is also believed to maximize energy transfer from the projectile 10 to the target.

The indentations 18 are equidistantly spaced from each other around a circumference of the ogive 14. The indentations 18 are also located at the same relative position along the longitudinal axis 17 between the tip 16 and the rearmost surface 13. That is, each indentation 18 in the ogive 14 is spaced from the rearmost surface 13 by the same distance. The indentations 18 can be defined in one aspect by their combined projected area in a plane normal to the longitudinal axis 17 relative to the total projected area of the ogive 14. The projected area of the indentations 18 in a plane normal to the longitudinal axis 17 can be from about 30% to about 60% of the total projected area of the ogive 14. In some embodiments, the projected area of the indentations 18 can be about 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, or 60% of the total projected area of the ogive 14. In one embodiment, the projected area of the indentations 18 in a plane normal to the longitudinal axis 17 can be 40% of the total projected area of the ogive 14.

Figure 4:
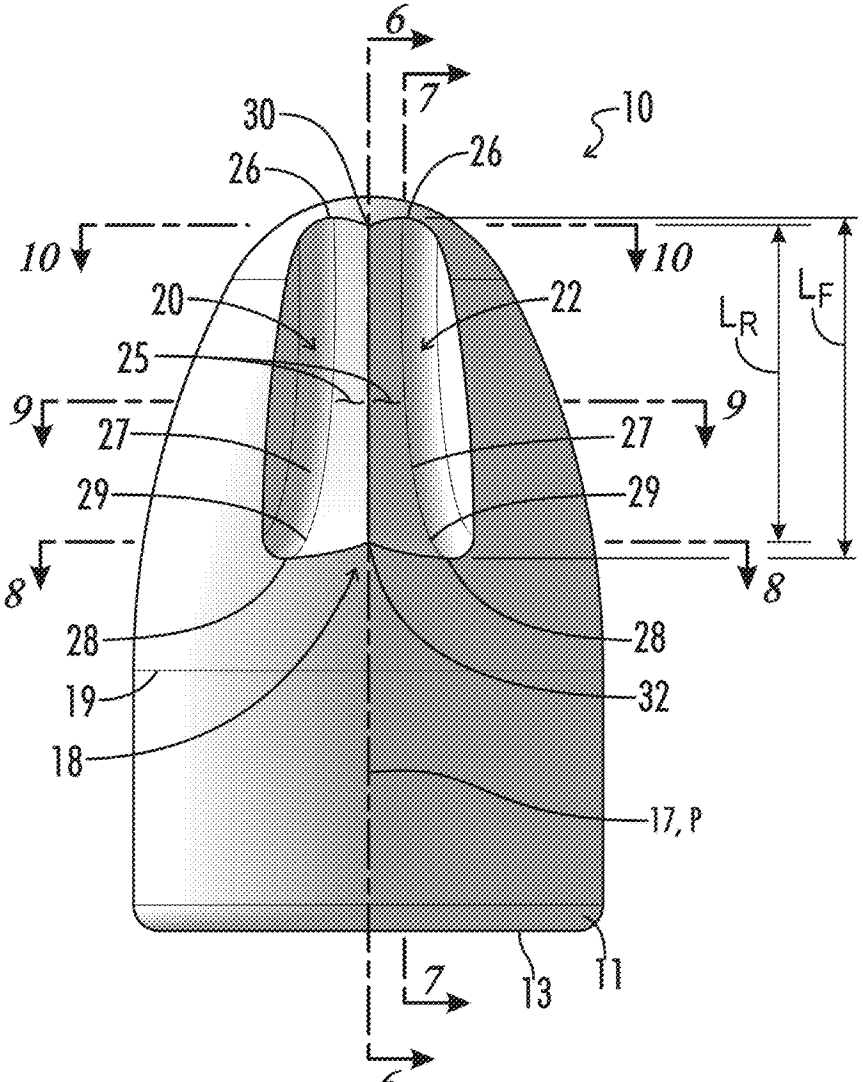
FIG. 4 is a first side view of the projectile of FIG. 1.

Each indentation 18 is formed by a pair of (i.e., two) adjacent grooves or flutes 20, 22 defined in the ogive 14. Each flute 20, 22 has a leading edge 26, a trailing edge 28, and a flute length $L_F$. The leading edge 26 of each flute 20, 22 is located proximate to the tip 16 of the ogive 14. The trailing edge 28 of each flute 20, 22 is located distal to the tip 16 and proximate to the margin 19 between the ogive 14 and the base portion 12. The flute length $L_F$ extends from a portion of the leading edge 26 nearest the tip 16 to a portion of the trailing edge 28 nearest the margin 19, as shown in FIG. 4. The flutes 20, 22 of the exemplar projectile 10 depicted in the figures are of substantially equal length $L_F$. The length $L_F$ of the flutes 20, 22 depicted in the figures is less than the length of the ogive 14 $L_O$. However, in other embodiments, it is contemplated that the flute length $L_F$ can be equal to or greater than the ogive length $L_O$.

The adjacent flutes 20, 22 forming each indentation or flute pair 18 are substantially symmetrical to each other and intersect along a central intersection curve or ridge 24. More specifically, adjacent surfaces 25 of each pair of adjacent flutes 20, 22 intersect along and thereby define the central ridge 24. As such, the adjacent flutes 20, 22 of each pair 18 define and are substantially symmetrical about the ridge 24. The adjacent flutes 20, 22 also extend longitudinally along a portion of the projectile length $L_P$ such that the central ridge 24 of each flute pair 18 is coplanar (i.e., in the same plane P) with the longitudinal axis 17 of the projectile 10. The central ridges 24 of the flute pairs 18 can function as cutting edges that facilitate formation of wound channels in any soft tissue penetrated by the projectile 10. This effect can become even more pronounced the faster that the projectile 10 is spinning when it impacts the target. In this way, the ridges 24 provide the projectile 10 with increased stopping power relative to traditional projectiles.

The central ridge 24 of each flute pair 18 has a ridge length $L_R$ extending from an origin 30 to a terminus 32 of the ridge. The origin 30 of each ridge 24 is proximate to the tip 16 of the ogive 14. The terminus 32 of each ridge 24 is distal to the tip 16 and proximate to the margin 19. The leading edges 26 of each pair 18 of adjacent flutes 20, 22 intersect at the origin 30 of each ridge 24. The trailing edges 28 of each pair 18 of adjacent flutes 20, 22 intersect at the terminus 32 of each ridge 24. The ridge length $L_R$ is less than the flute length $L_F$.

Referring now to FIGS. 2 and 8-10, the adjacent surfaces 25 defining each central ridge 24 form a V-shape in every plane normal to the longitudinal axis 17 along the length $L_R$ of the ridge 24. Consequently, the central ridge 24 of each flute pair 18 has a substantially triangular cross section in every plane normal to the longitudinal axis 17 along the length $L_R$ of the ridge 24 from the origin 30 to the terminus 32.

Figure 10:
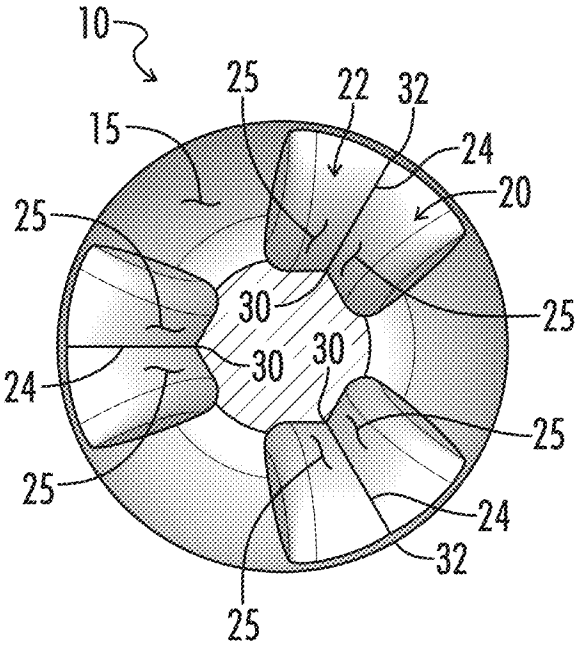
FIG. 10 is a sectional view taken substantially along line 10-10 of FIG. 4.
Figure 9:
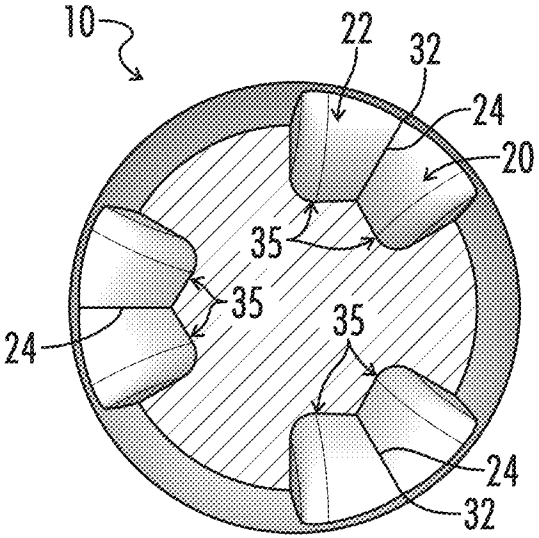
FIG. 9 is a sectional view taken substantially along line 9-9 of FIG. 4.
Figure 8:
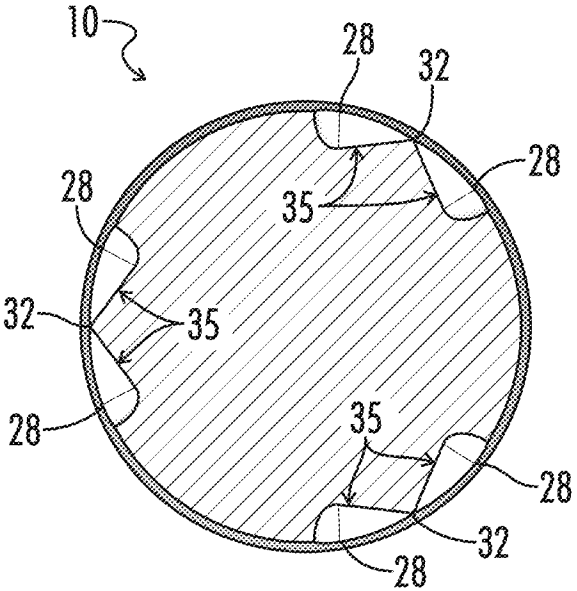
FIG. 8 is a sectional view taken substantially along line 8-8 of FIG. 4.

The adjacent surfaces 25 of each pair 18 of adjacent flutes 20, 22 also define a ridge angle 35. The ridge angle 35 is the included (i.e., interior) angle defined between the adjacent surfaces 25 of each flute pair 18 in a cross section of the ridge 24 orthogonal to the longitudinal axis 17, as shown in FIGS. 8-10. The ridge angle 35 must be less than 180 degrees at every point along the length $L_R$ of the ridge 24 from the origin 30 to the terminus 32 in order for the ridge 24 to provide a cutting edge. In some embodiments, the ridge angle 35 can remain constant along the length $L_R$ of the ridge 24. In preferred embodiments, the ridge angle 35 decreases by one or more degrees along the length $L_R$ of the ridge 24 from the origin 30 to the terminus 32. For example, the ridge angle 35 can be an obtuse angle along the entire ridge length $L_R$, or the ridge angle 35 can range from an obtuse angle to an acute angle from the origin 30 to the terminus 32. In some embodiments, the ridge angle 35 can be an obtuse angle which decreases by about 5 to about 30 degrees over the length $L_R$ of the ridge 24 from the origin 30 to the terminus 32. In a specific embodiment, the ridge angle 35 can be an obtuse angle which decreases by about 5, 6, 7, 8, 9, 10, 11, 12, 13, 14, 15, 16, 17, 18, 19, 20, 21, 22, 23, 23, 24, 25, 26, 27, 28, 29, or 30 degrees over the length $L_R$ of the ridge 24 from the origin 30 to the terminus 32.

In additional embodiments, the ridge angle 35 can range from about 120 degrees to about 60 degrees along the length $L_R$ of the ridge 24. In preferred embodiments, the ridge angle 35 can range from about 120 degrees to about 90 degrees along the length $L_R$ of the ridge 24 from the origin 30 to the terminus 32. In specific embodiments, the ridge angle 35 can range from about 120, 119, 118, 117, 116, 115, 114, 113, 112, 111, 110, 109, 108, 107, 106, 105, 104, 103, 102, 101, 100, 99, 98, 97, 96, or 95 degrees at the origin 32, to about 115, 114, 113, 112, 111, 110, 109, 108, 107, 106, 105, 104, 103, 102, 101, 100, 99, 98, 97, 96, 95, 94, 93, 92, 01, or 90 degrees at the terminus 32.

Figure 7:
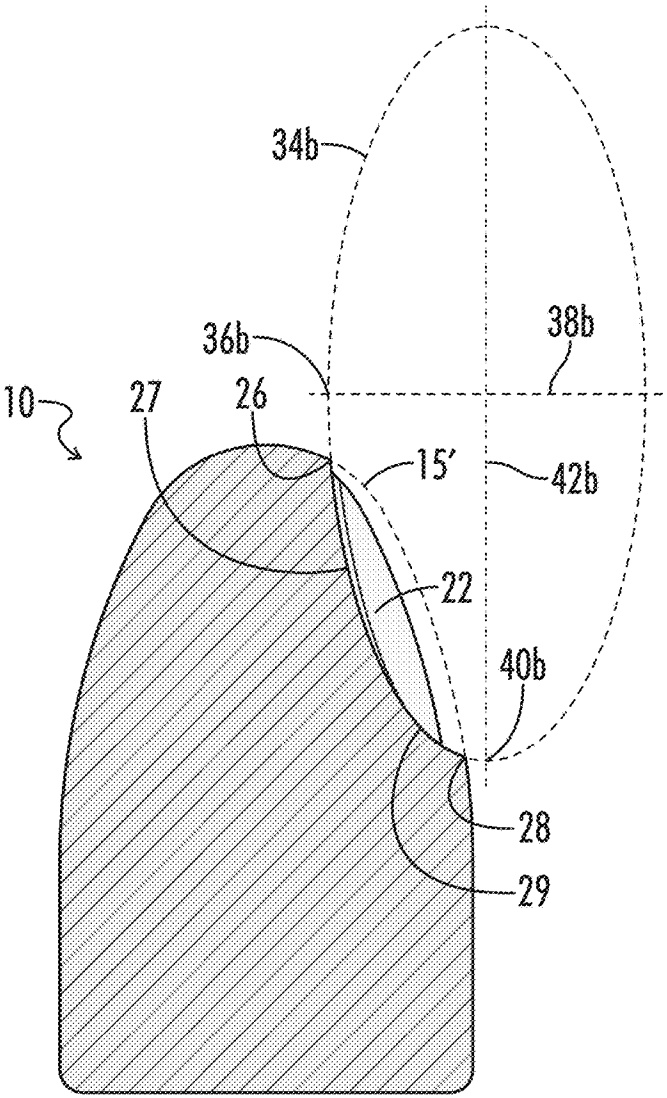
FIG. 7 is a sectional view taken substantially along line 7-7 of FIG. 4.
Figure 6:
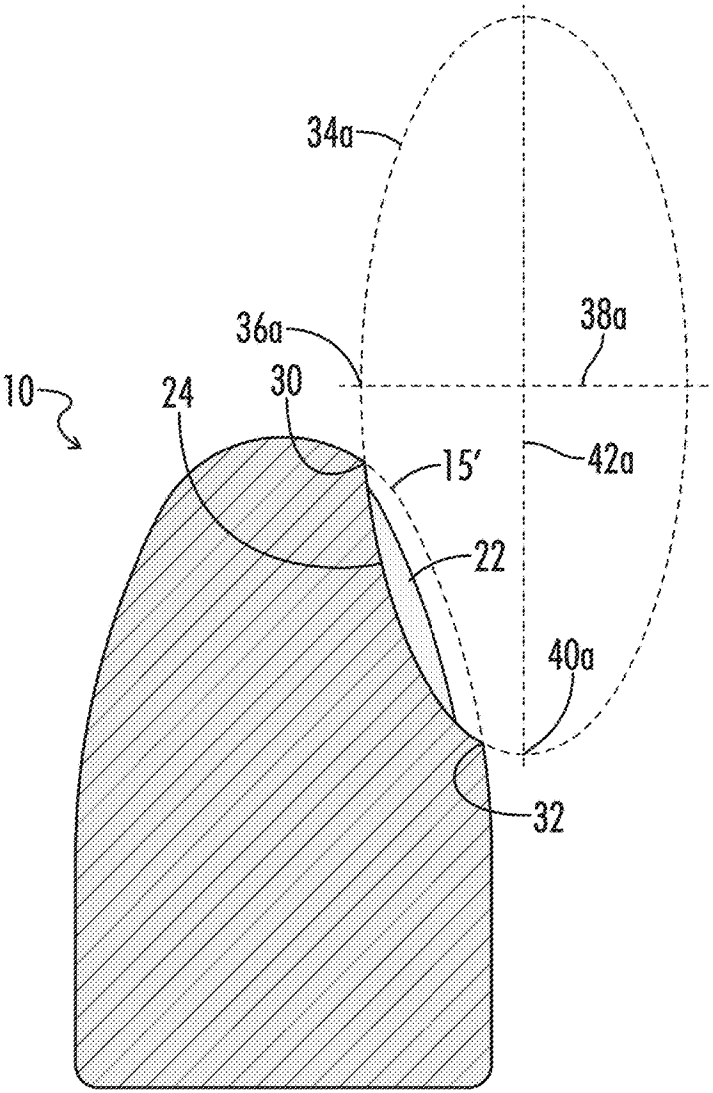
FIG. 6 is a sectional view taken substantially along line 6-6 of FIG. 4.

The central ridge 24 of each flute pair 18 has a lesser depth relative to a curved outer reference surface 15' of the ogive 14 than a lowermost (i.e., bottom) surface 27 of the adjacent flutes 20, 22 (e.g., compare FIGS. 6 and 7, respectively). The curved outer reference surface 15' is the curved outer surface 15 of the ogive 14 that would be present but for the flutes 20, 22. Put another way, the ridge 24 is recessed from the curved outer reference surface 15'. Each central ridge 24 is concave in that a longitudinal section of the projectile 10 taken along the ridge 24 has a profile with a concave portion which corresponds to the ridge 24, as best shown in FIG. 6. As such, the profile of the ridge 24 can form an arc of a first reference ellipse 34*a*. In this way, the ridge 24 can have an elliptical profile.

In some embodiments, the profile of a longitudinal section of each ridge 24 can form an arc of the reference ellipse 34*a* extending from a first position proximate to a co-vertex 36*a* of a minor axis 38*a* of the ellipse 34*a* to a second position proximate to a vertex 40*a* of a major axis 42*a* of the ellipse 34*a*, wherein the first position corresponds to the origin 30 of the ridge 24 and the second position corresponds to the terminus 32 of the ridge 24. As a result, the ridge 24 can have a radius of curvature which decreases along the length $L_R$ of the ridge 24 from the origin 30 to the terminus 32, as best shown in FIG. 6. In the embodiment shown in the figures, each central ridge 24 has the same longitudinal radius of curvature. In other embodiments, the ridge 24 can have a constant radius of curvature along its length $L_R$. In still other embodiments, it is contemplated that the ridge 24 can have a constant slope oriented at an angle relative to the longitudinal axis 17, instead of a radius of curvature. However, it is believed that a central ridge 24 having a decreasing radius of curvature as depicted herein provides better cutting and an increased breaking effect when penetrating soft tissue targets.

Referring now to FIG. 7, each flute 20, 22 also has an elliptical profile. Specifically, a longitudinal section of each flute 20, 22 has a profile which forms an arc of a second reference ellipse 34*b*. In some embodiments, the leading edge 26 of each flute 20, 22 can correspond to a portion of the ellipse 34*b* proximate to the co-vertex 36*b* of the minor axis 38*b* of the ellipse 34*b* and the trailing edge 28 of each flute 20, 22 can correspond to a portion of the ellipse 34*b* proximate to the vertex 40*b* of the major axis 42*b* of the ellipse 34*b*. Put differently, the profile of a longitudinal section of each flute 20, 22 can form an arc of the second reference ellipse 34*b* extending from a first position proximate to a co-vertex 36*b* of a minor axis 38*b* of the ellipse 34*b* to a second position proximate to a vertex 40*b* of a major axis 42*b* of the ellipse 34*b*, wherein the first position corresponds to the leading edge 26 of the flute 20, 22 and the second position corresponds to the trailing edge 28 of the flute 20, 22.

In additional embodiments, the leading edge 26 of each flute 20, 22 can correspond to the co-vertex 36*b* of the ellipse 34*b* and the trailing edge 28 of each flute 20, 22 can correspond to the vertex 40*b* of the ellipse 34*b*. In other words, the profile of a longitudinal section of each flute 20, 22 can form an arc of a reference ellipse 34*b* extending from a co-vertex 36*b* of a minor axis 38*b* of the ellipse 34*b* to a vertex 40*b* of a major axis 42*b* of the ellipse 34*b*, wherein the co-vertex 36*b* corresponds to the leading edge 26 of the flute 20, 22 and the vertex 40*b* corresponds to the trailing edge 28 of the flute 20, 22. In the embodiment depicted in the figures, the first reference ellipse 34*a* is differently sized than the second reference ellipse 34*b*. However, in some embodiments, it is contemplated that the first and second reference ellipses 34*a*, 34*b* can be the same size.

Figure 2:
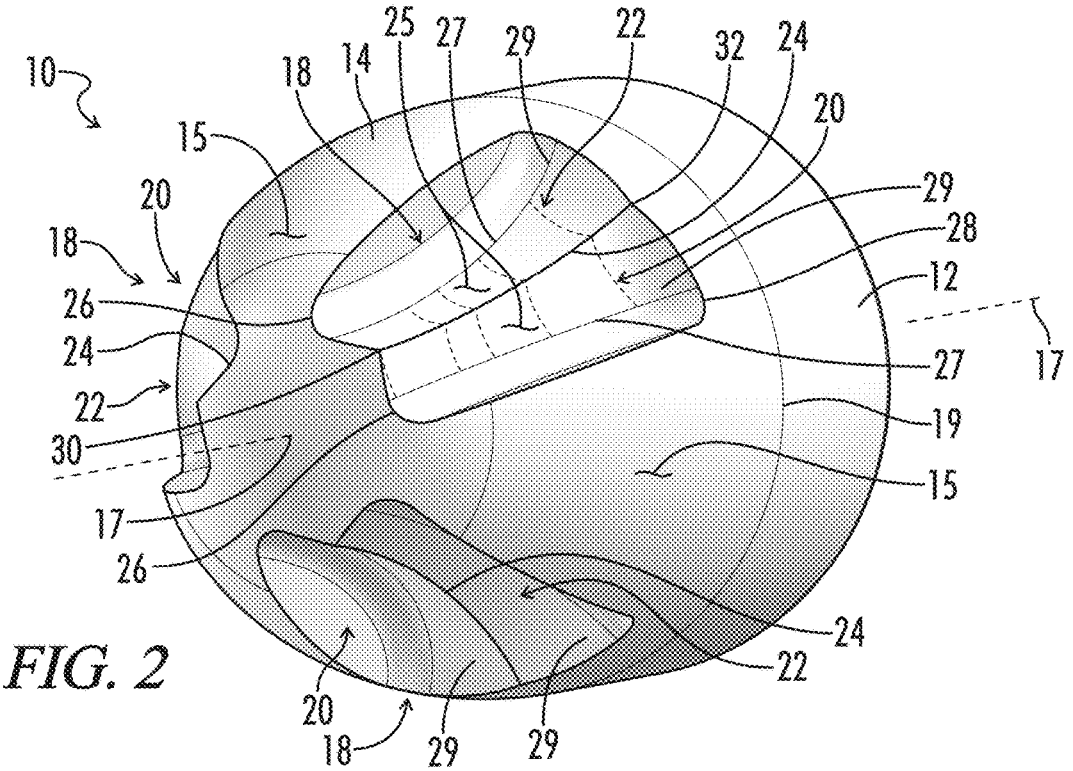
FIG. 2 is another isometric view of the projectile of FIG. 1.
Figure 3:
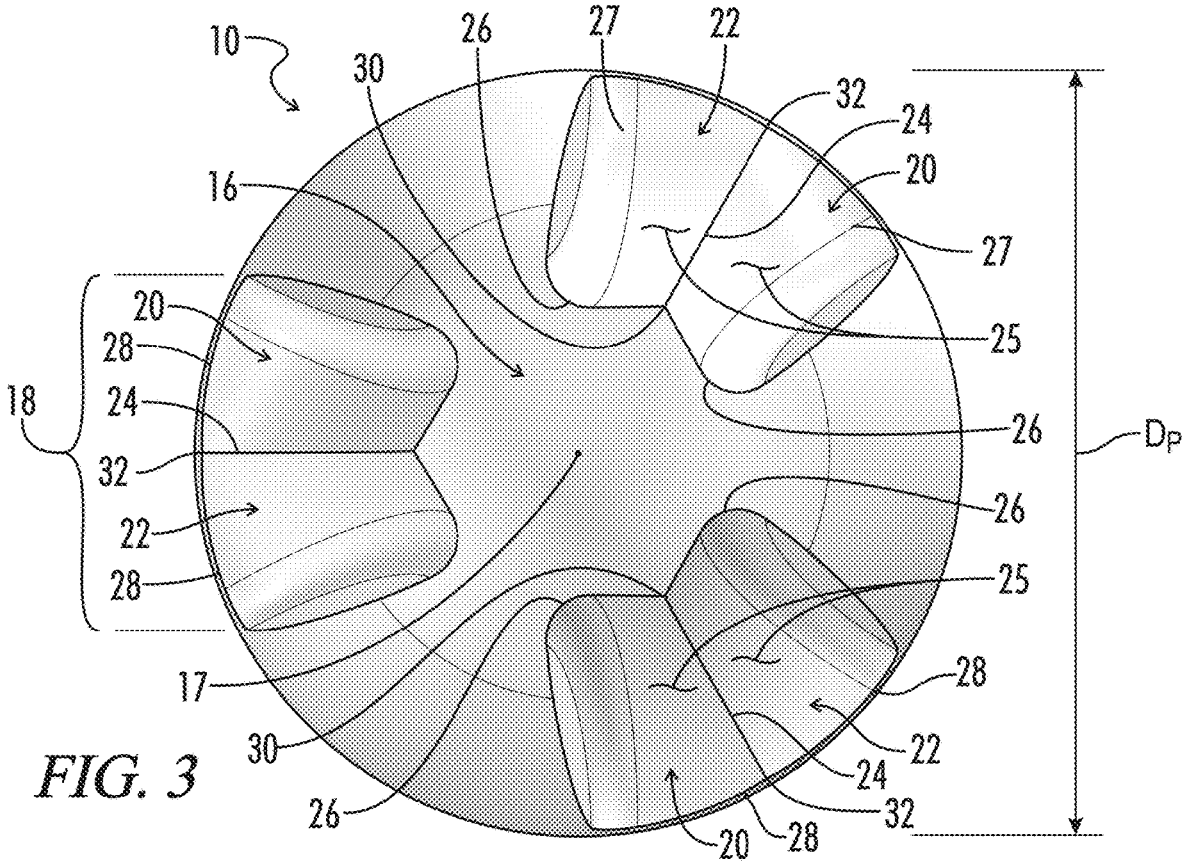
FIG. 3 is a front view of the projectile of FIG. 1.
Figure 5:
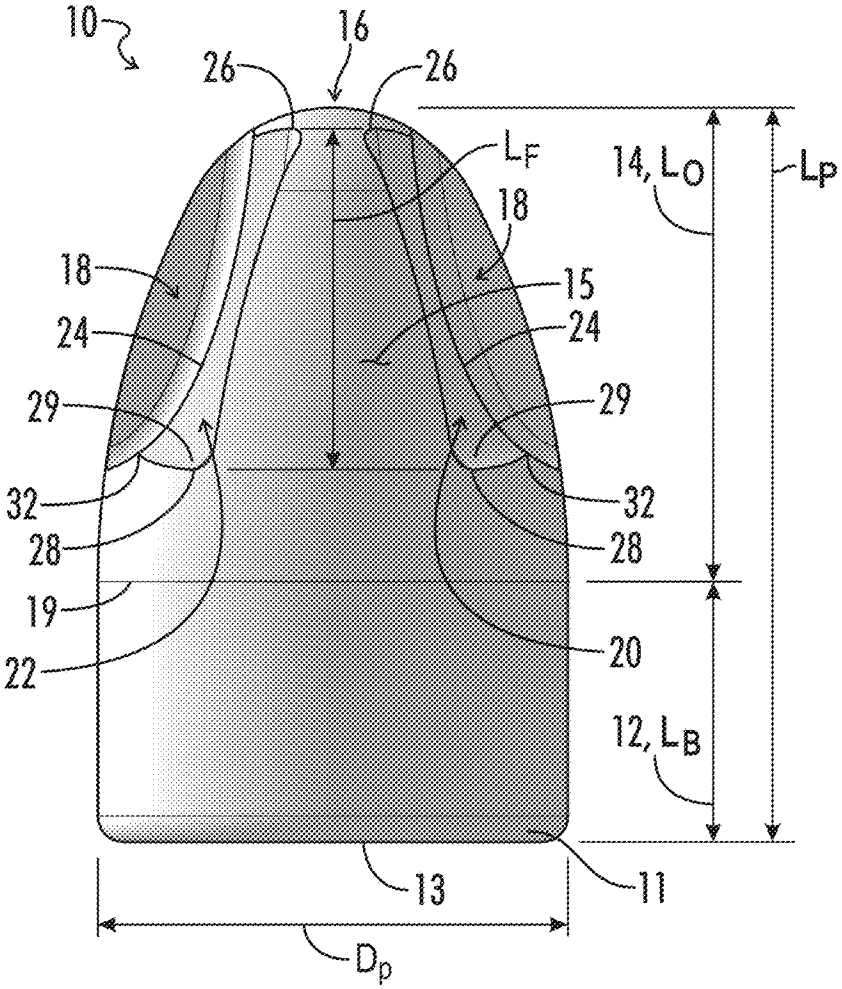
FIG. 5 is a second side view of the projectile of FIG. 1 showing the projectile rotated 180 degrees around the longitudinal axis from the position shown in FIG. 4.

Each flute 20, 22 has a radius of curvature that decreases along the longitudinal axis 17. In some embodiments, the longitudinal radius of curvature can decrease along a portion of the flute length $L_F$. In other embodiments, the longitudinal radius of curvature can decrease along the entire length of the flute $L_F$. In a preferred embodiment, the longitudinal radius of curvature decreases from the leading edge 26 to the trailing edge 28 of each flute 20, 22. In the embodiment shown in the figures, each flute 20, 22 of each flute pair 18 has substantially the same longitudinal radius of curvature. The decreasing longitudinal radius of curvature causes the lowermost surface (i.e., the bottom surface) 27 of each flute 20, 22 to flare radially outward from the longitudinal axis at the rear portion 29 of each flute 20, 22 toward the trailing edge 28. As such, the bottom surface 27 becomes increasingly less recessed from (i.e., shallower relative to) the curved outer reference surface 15' of the ogive 14 toward the trailing edge 28 of each flute 20, 22, as best illustrated in FIGS. 2, 3, and 5. In addition, as best seen in FIG. 3, each flute also has a flute width $W_F$ which increases along the length of the flute $L_F$ from the leading edge 26 to the trailing edge 28. As a result, each flute 20, 22 is narrowest at its leading edge 26 and widest at its trailing edge 28.

The pairs 18 of adjacent flutes 20, 22 formed in the projectiles 10 disclosed herein transfer generate significant hydraulic force when impacting soft targets, such as animals, persons, and ballistic gels, while simultaneously reducing the chances of the projectile 10 over penetrating the target. In one aspect, the combination of decreasing longitudinal radius of curvature, decreasing flute depth, and increasing flute width $W_F$ toward the trailing edge 28 of each flute 20, 22 causes the adjacent flutes 20, 22 of each pair 18 to function like scoops when the projectile 10 impacts a soft target.

Specifically, upon impact of a projectile 10 disclosed herein with a soft target, soft tissues and fluids such as blood and water within the target enters the flutes 20, 22 at the leading edges 26. As the projectile 10 penetrates further into the target, increasing amounts of soft tissues and fluids enter the widening flutes 20, 22, which funnel the tissues and fluids rearwardly toward the flared rear portion 29 of each flute 20, 22. As the fluids and soft tissues reach the trailing edges 28 of the flutes 20, 22, built up hydraulic pressure forces the fluids and soft tissues radially outward and away from the longitudinal axis 17. This creates a devastating wound channel or cavity in the target which more quickly incapacitates the target. At the same time, the increasing angle of the bottom surface 27 of the flutes 20, 22 relative to the longitudinal axis 17 causes fluids and soft tissues moving rearwardly through the flutes 20, 22 to apply a slowing or braking effect to the projectile 10 as these materials contact the flared rear portion 29 of each flute. This increases the transfer of kinetic energy from the projectile 10 to the target while reducing the chance that the projectile will over penetrate the target. In this way, the projectile 10 maximizes projectile energy transfer while minimizing the risk of over penetration by the projectile.

The projectiles 10 described herein can be manufactured in any diameter or caliber as a monolithic, non-expandable projectile or bullet. Calibers in which the projectiles 10 disclosed herein are believed to be especially effective include but are not limited to 0.32, 0.357, 0.380, 0.40, 0.45, 9 mm, and 10 mm. Suitable materials from which the projectiles 10 described herein can be manufactured include metallic materials (e.g., copper, lead, and the like), polymeric materials, and composites of one or more polymeric materials and one or more metallic materials. Suitable metallic, polymeric, and composite materials are well known in the art and include, for example, the materials disclosed in U.S. Pat. No. 10,126,105. Manufacture of the projectiles 10 disclosed herein can achieved by various processes used in the manufacture of other metallic, polymeric, and polymeric composite monolithic projectiles, such as injection molding, sintering, die casting, machining, and the like. In one embodiment, projectiles 10 disclosed herein can be injection molded using a polymer matrix embedded with a mixture of metallic particles, such as copper particles.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful PROJECTILE FOR FIREARMS, it is not intended that such references be construed as limitations upon the scope of this invention except as set forth in the following claims.

What is claimed is:

1. A projectile, comprising:

a body defining a longitudinal axis and an ogive; and a plurality of pairs of adjacent flutes defined in the ogive; wherein:

each pair of adjacent flutes defines and is substantially symmetrical about a central ridge;

a longitudinal section of each flute has a profile which forms an arc of an ellipse extending from a first position proximate to a co-vertex of a minor axis of the ellipse to a second position proximate to a vertex of a major axis of the ellipse;

a leading edge of each flute corresponds to the first position; and a trailing edge of each flute corresponds to the second position.

2. The projectile of claim 1, wherein each flute:

extends along the longitudinal axis; and has a radius of curvature which decreases between the leading edge and the trailing edge of the flute.

3. The projectile of claim 1, wherein each flute has a radius of curvature which decreases along a length of the flute from the leading edge to the trailing edge of the flute.

4. The projectile of claim 1, wherein the ridge has a radius of curvature which decreases along a length of the ridge from an origin to a terminus of the ridge.

5. The projectile of claim 1, wherein a projected area of the plurality of pairs of adjacent flutes in a plane normal to the longitudinal axis is between 30% and 60% of a total projected area of the ogive.

6. The projectile of claim 1, wherein the ridge is coplanar with the longitudinal axis.

7. The projectile of claim 1, wherein adjacent surfaces of the adjacent flutes of each pair intersect along and define the ridge.

8. The projectile of claim 7, wherein the adjacent surfaces define an included angle of between 90 and 120 degrees.

9. The projectile of claim 1, wherein the ridge is substantially V-shaped along a length of the ridge.

10. The projectile of claim 1, wherein a profile of an exterior surface of a cross section of the ridge normal to the longitudinal axis is substantially V-shaped.

11. The projectile of claim 10, wherein the profile of the exterior surface of the cross section of the ridge is substantially V-shaped in every plane normal to the longitudinal axis between an origin and a terminus of the ridge.

12. The projectile of claim 1, wherein:

the ridge is concave;

the ogive defines a curved outer reference surface; and the ridge is recessed from the curved outer reference surface.

13. The projectile of claim 1, wherein:

the ridge is concave;

the ogive defines a curved outer reference surface;

the ridge has a lesser depth relative to the curved outer reference surface than a bottom surface of the adjacent flutes; and a rear portion of a bottom surface of each flute flares radially outward from the longitudinal axis.

14. The projectile of claim 1, wherein each pair of adjacent flutes is spaced around the ogive from each other pair of adjacent flutes.

15. A projectile, comprising:

a body defining a longitudinal axis, a cylindrical base portion, and a tapered impact portion having a curved outer surface; and three indentations defined in the impact portion; wherein:

the indentations are equidistantly spaced around a circumference of the impact portion;

the indentations are located at the same relative position along the longitudinal axis;

each indentation is formed by two substantially symmetrical curved surfaces;

the two curved surfaces intersect along a ridge;

the ridge is coplanar with the longitudinal axis; and the ridge has a lesser depth relative to the outer surface than a bottom of the two curved surfaces.

16. The projectile of claim 15, wherein the ridge has a V-shaped cross section along a length of the ridge from an origin to a terminus of the ridge.

17. A projectile, comprising:

a body defining a longitudinal axis and an ogive; and a plurality of pairs of adjacent flutes defined in the ogive; wherein:

each pair of adjacent flutes defines and is substantially symmetrical about a central concave ridge;

the ogive defines a curved outer reference surface;

the concave ridge has a lesser depth relative to the curved outer reference surface than a bottom surface of the adjacent flutes; and a rear portion of a bottom surface of each flute flares radially outward from the longitudinal axis.

* * * * *